United States Patent [19]

Fontana

[11] 4,033,162

[45] July 5, 1977

[54] KEY CASE HEAD

[75] Inventor: Giampiero Fontana, Milan, Italy

[73] Assignee: Buxton, Incorporated, Agawam, Mass.

[22] Filed: Nov. 10, 1975

[21] Appl. No.: 630,755

[30] Foreign Application Priority Data

Nov. 14, 1974 Italy ..... 29447/74

[52] U.S. Cl. ..... 70/456 B
[51] Int. Cl.[2] ..... A47G 29/10
[58] Field of Search ..... 70/456 B, 456 R, 459; 24/3 K; 150/40

[56] References Cited

UNITED STATES PATENTS

| | | | |
|---|---|---|---|
| 2,051,432 | 8/1936 | Zahn | 150/40 |
| 2,421,492 | 6/1947 | Geller | 70/456 B |
| 2,680,369 | 6/1954 | Koelling | 70/456 B |

FOREIGN PATENTS OR APPLICATIONS

| | | | |
|---|---|---|---|
| 1,111,627 | 9/1954 | France | 70/456 B |

*Primary Examiner*—Paul R. Gilliam
*Assistant Examiner*—Kenneth J. Dorner
*Attorney, Agent, or Firm*—Richard A. Wise; Oistein J. Bratlie; Scott R. Foster

[57] ABSTRACT

A holder or key case head for a key case or pouch, the head being so constructed as to render insertion and removal of keys relatively effortless.

4 Claims, 6 Drawing Figures

KEY CASE HEAD

BACKGROUND OF THE INVENTION

1. Field of the Invention

This invention relates to key cases or pouches and is directed more particularly to a key case head for retaining keys within a key case.

2. Description of the Prior Art

Key cases and pouches, made of relatively rigid or flexible material and provided with a key holding component, are well known. The key holding component generally contains a number of rings, or hooks, arranged in a row. In many cases, the rings or hooks are linked to a supporting base that is attached to the case. The keys are attached to the rings or hooks.

In order to remove one or more keys from the case, or to attach additional keys to the case, a key is detached or attached to its corresponding ring, the ring being permanently secured to the base member of the key head. Operation of the key ring so as to remove or to attach a key is often difficult and aggravating.

SUMMARY OF THE INVENTION

An object of the present invention is to provide a key case head for use with a key case or pouch, the head being provided with means for retaining key rings therein, but having facility for releasing a desired key ring in a convenient and reliable manner.

A further object of the invention is to provide a device as above described which is economical to manufacture and easy to incorporate in present constructions of key cases.

With the above and other objects in view, as will hereinafter appear, a feature of the present invention is the provision of a key case head having an inner stationary assembly which includes a shaft anchored to an inner surface of a key case panel. The inner stationary assembly is further provided with a longitudinal portion parallel to the shaft and a series of spaced discs interconnecting the shaft and the longitudinal portion. The inner stationary assembly is adapted to receive enlarged holding portions or heads, of key rings. Surrounding the shaft and longitudinal portion is a cylindrical portion having spaced slots each slot being disposed between two of said discs and each slot terminating in an opening larger than the head of a key ring. The cylindrical portion is biased to a position in which the enlarged opening is disposed over the longitudinal portion of the inner stationary assembly. In this position the head of the key ring cannot reach the opening in the cylindrical portion and is thereby retained. Rotation of the cylindrical portion against the bias force brings the opening in the cylindrical portion to a point where the head of the key ring will pass through the opening to allow the key ring, and thereby its retained key, to be removed. Upon release of the cylindrical portion it returns under the biasing force to its normal position in which removal of a key ring is obstructed.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
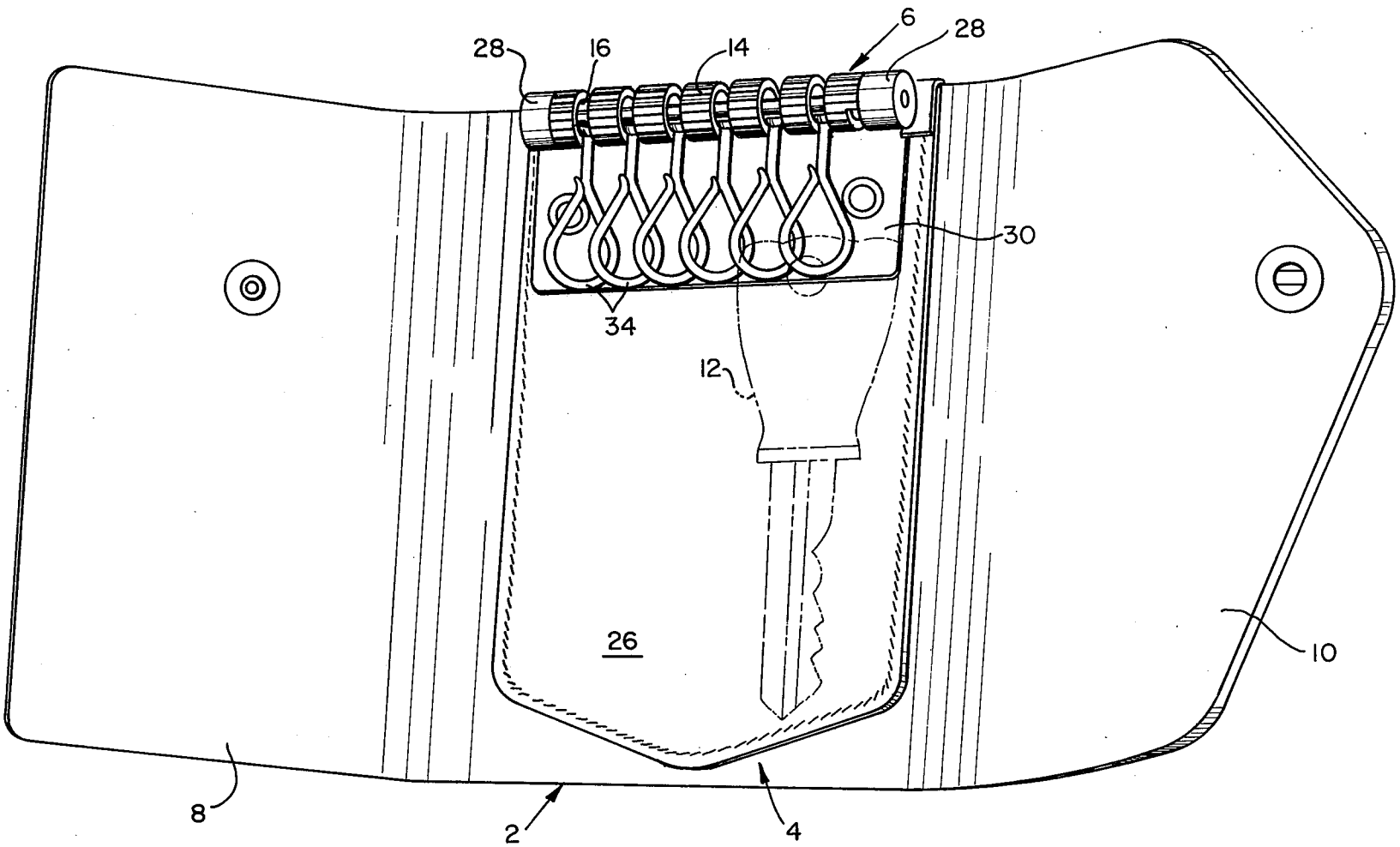
FIG. 1 is a perspective view of one form of key case head illustrative of an embodiment of the invention.

Referring to FIG. 1, it will be seen that the illustrative key case 2 is a well known type, made of flexible leather, artificial leather, or other suitable material. The key case includes a center flap 4 which serves to support the key case head 6 and which has end flaps 8 and 10 adapted to be folded over the center flap 4 and secured together to cover the key case head 6 and keys 12 retained thereby. The key case head 6 includes a cylindrical portion 14 having parallel circumferential slots 16 which are appropriately spaced, as may be seen in FIGS. 1, 4 and 5. At the end of each slot there is an enlarged portion 18 (FIG. 5).

Figure 3:
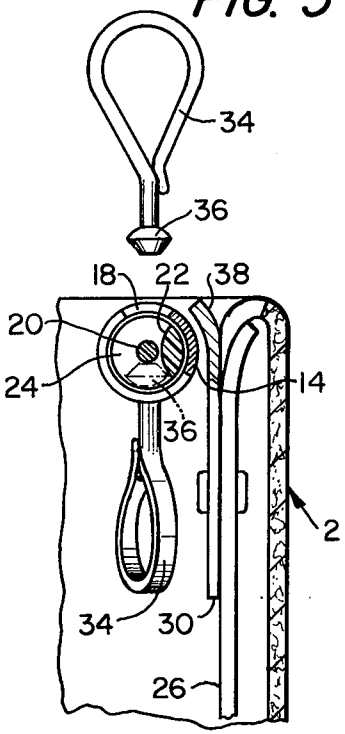
FIG. 3 is similar to FIG. 2 but shows the operating mechanism of the invention in a different position.
Figure 6:
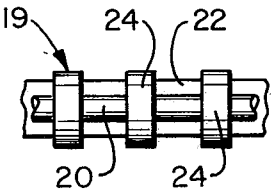
FIG. 6 is a front elevational view of a portion of the device.

The cylindrical portion 14 is rotatably disposed upon an inner stationary assembly 19 including a shaft 20 and a longitudinal portion 22 and which further has discs 24 which occupy the spaces between successive slots 16. The key case head 2 is mounted on the case by means of the shaft 20 which is held by end knobs 28 that are attached to a metal strip 30 (FIGS. 2 and 3) which in turn is attached to a panel 26 overlying and secured to the center flap 4 of the key case 2. A spring 32 is placed between an end of the cylindrical portion 14 and an end knob 28 (FIG. 4) and exercises a biasing force on the cylindrical portion 14.

Key rings 34 are provided with enlarged heads, or holding portions 36 (FIGS. 2–5) having a diameter slightly smaller than the diameter of the enlarged portions 18 of the slots 16 but otherwise larger than the width of the slots 16, such that a key ring head 36 may be retained in a slot 16 but removable through the enlarged portion 18 of a slot 16.

Figure 4:
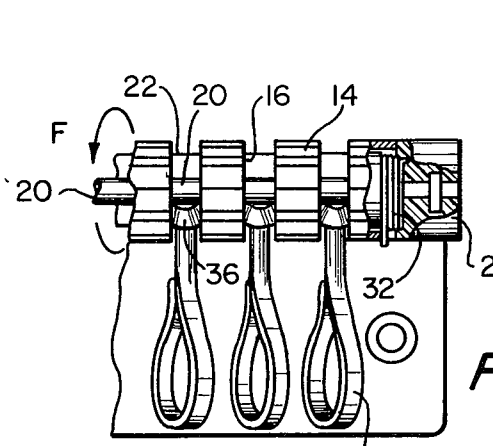
FIG. 4 is a front elevational view, partly broken away, showing a portion of the key case head in detail.
Figure 5:
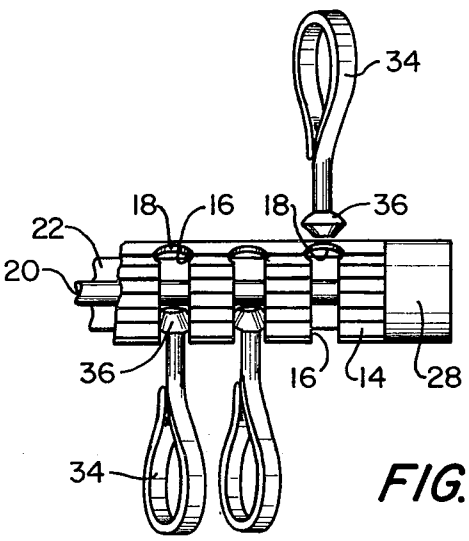
FIG. 5 is similar to FIG. 4 but shows the operating mechanism of the device in a different position.
Figure 2:
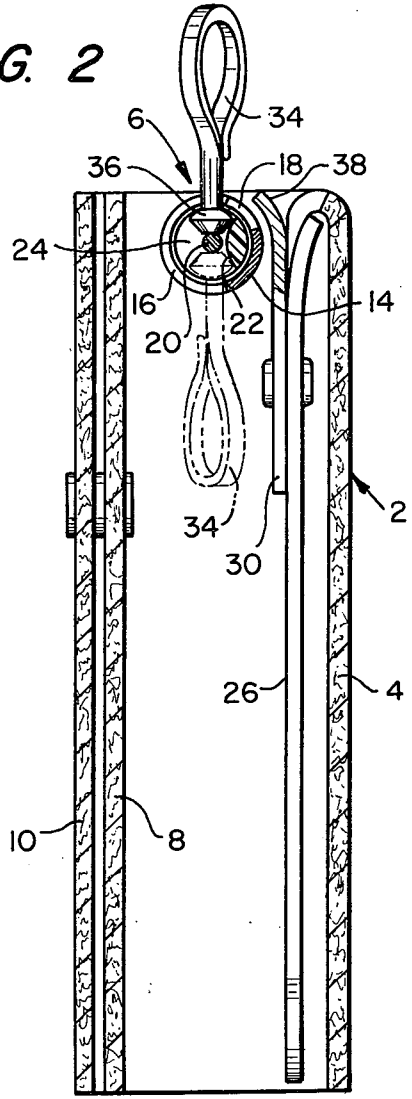
FIG. 2 is a side cross sectional view.

The spring 32 ordinarily biases the cylindrical portion 14 in the position shown in FIGS. 2 and 4, in which its enlarged slot portions 18 are obstructed by the longitudinal portion 22. The enlarged slot portions 18 may further be partially covered by a curved edge 38 of the metal strip 30. In this position, it is impossible to add or remove key rings from the cylindrical portion 14.

In order to remove or add a key ring, the cylindrical portion 14 is manually rotated against the force of the spring 32 until the enlarged slot portions 18 are cleared (FIG. 3), at which point a key ring head 36 may be introduced or removed through the slot portion 18 and moved along a slot 16 to or from the portion 18. When the manual pressure applied to the cylindrical portion 14 is removed, the spring 32 returns the cylindrical portion to its ordinary position in which addition or removal of the key rings is obstructed. Thus, to detach or attach one or more keys from the key case is a relatively simple and rapid procedure.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A key case head for releasably retaining a key ring having an enlarged head portion at one end thereof, the key case head comprising an inner stationary assembly having means for attachment to a key case including a shaft, a longitudinal portion extending parallel to and coextensive with said shaft, and disc means mounted on said shaft and longitudinal portion for receiving said enlarged head portion of said key ring therebetween, and a cylindrical portion disposed upon said inner stationary assembly and having a circumferential slot therein smaller in width than the diameter of said enlarged head portion, and an enlarged slot portion larger in diameter than said enlarged head portion, said key case head longitudinal portion obstructing movement of said enlarged head portion through said enlarged slot portion, said cylindrical portion being rotatable against a spring bias to a position in which said enlarged slot portion is clear of said longitudinal portion, whereby to permit passage of said enlarged head portion through said enlarged slot portion.

2. The invention according to claim 1 in which said cylindrical portion is provided with a plurality of said circumferential slots and a disc means is disposed on either side of each of said circumferential slots.

3. The invention according to claim 1 in which said shaft is held by a pair of end knobs attached to a metal strip.

4. The invention according to claim 3 in which a spring biasing means is disposed in one of said knobs and operates to bias said cylindrical portion such that its enlarged slot portions are obstructed by said longitudinal portion.

* * * * *